United States Patent [19]

Yates

[11] Patent Number: 4,534,453

[45] Date of Patent: Aug. 13, 1985

[54] BRAKE LEVER ASSEMBLY FOR RAILWAY CAR

[75] Inventor: Donald B. Yates, Homewood, Ill.

[73] Assignee: Pullman Standard, Inc., Chicago, Ill.

[21] Appl. No.: 542,721

[22] Filed: Oct. 17, 1983

[51] Int. Cl.[3] ..... B61H 13/20; B61H 13/38

[52] U.S. Cl. ..... 188/52; 188/199; 188/205 R; 188/216

[58] Field of Search ..... 188/52, 53, 54, 55, 188/153 R, 153 A, 198, 199, 205 R, 216, 47

[56] References Cited

U.S. PATENT DOCUMENTS 1,674,831 6/1928 Lounsbury ..... 188/216
2,699,231 1/1955 Dorey ..... 188/198

FOREIGN PATENT DOCUMENTS 26625 of 1904 United Kingdom ..... 188/216

*Primary Examiner*—Douglas C. Butler
*Assistant Examiner*—Richard R. Diefendorf
*Attorney, Agent, or Firm*—Richard J. Myers

[57] ABSTRACT

A brake cylinder lever on a railway car is supported in a substantially vertical orientation by a roller mounted on an inclined ramp to bias the brake system toward a "brake off" or nondrag condition.

13 Claims, 3 Drawing Figures

BRAKE LEVER ASSEMBLY FOR RAILWAY CAR

BACKGROUND OF THE INVENTION

1. Field of the Invention

This invention relates to mounting and supporting a brake cylinder lever on a railway car.

2. Description of the Prior Art

Brake cylinder levers are conventionally mounted on a railway car in a generally horizontal position which in the past has required cutting an opening in a portion of the center sill of the car to enable the lever to move and pivot sufficiently to apply the car's brakes when the fluid-operated brake cylinder is actuated or extended.

The opening in the center sill inherently weakens the sill so reinforcement of the center sill adjacent the opening is generally required. This construction generally is expensive to fabricate and adds a significant amount of extra weight to the car. Additionally this conventional lever arrangement has no inherent biasing tendency to bias the brake cylinder toward the closed or "brake off" position.

SUMMARY OF THE INVENTION

The brake cylinder lever of the brake cylinder of a railway car is mounted in a substantially vertical orientation and supported by a roller on an inclined ramp to enable the lever to be mounted on the car without weakening the center sill or adding excess weight to the car. Support of the lever by a roller on an inclined ramp inherently urges the brake system towards a closed or "brake off" position to minimize the possibility of the brake shoes dragging on the braking surfaces, such as the wheel treads.

DETAILED DESCRIPTION OF THE PREFERRED EMBODIMENT

Figure 1:
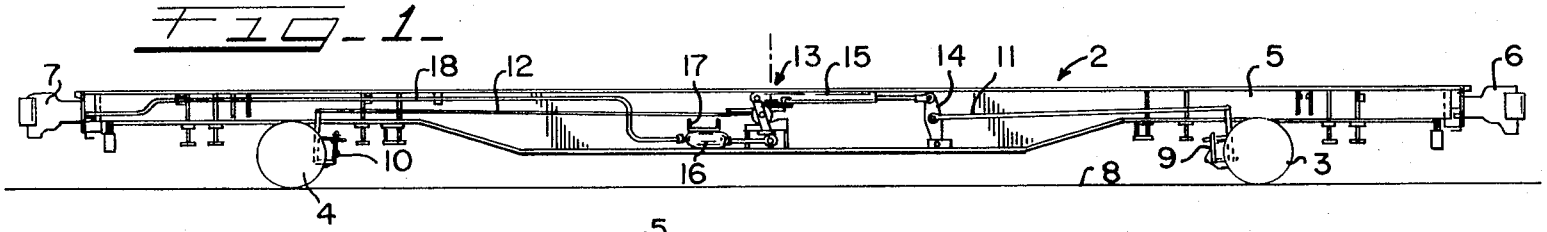
FIG. 1 is a side elevation of a railway car having a brake system having this invention.

FIG. 1 shows a railway car 2 having a pair of wheel trucks 3 and 4, a main longitudinally extending draft and load bearing member, such as conventional center sill 5, and connection means for connecting to other cars, such as couplers 6 and 7.

Wheel trucks 3 and 4 are generally rollingly disposed on an appropriate support surface, such as the top surface 8, of a set of railway tracks.

Each of the wheel trucks 3 and 4 are normally provided with a brake means, such as a brake beam 9 and 10, respectively, which are selectively forced into frictional engagement with a portion of the wheel to resist rolling of the wheel on the track.

Brake beams 9 and 10 are pivotally mounted to bracketry (not shown) on the center sill and selectively forced into frictional engagement with the wheels on the wheel trucks by connective or linkage means, such as brake rods 11 and 12.

As shown in FIG. 1, brake rod 11 is indirectly linked to a brake cylinder and lever assembly, generally indicated as 13, by a dead lever 14 and a slack adjuster assembly 15. Brake rod 12 is directly linked to assembly 13.

A fluid-operated brake cylinder 16 is mounted on the center sill by appropriate bracketry 17 and is connected to a source of fluid pressure, such as pressurized air, by appropriate connection means, such as air line or conduit 18. A quick connect-disconnect coupling (not shown) is normally provided adjacent each of the couplers 6 and 7 to engage air conduit 18, and a comparable air line (not shown) connects cylinder 16 to that end of the car adjacent coupler 6, to connect the cylinder in fluid flow communication with a source of pressurized air remote from car 2, as is well known to those skilled in the art of railway car construction.

Figure 3:
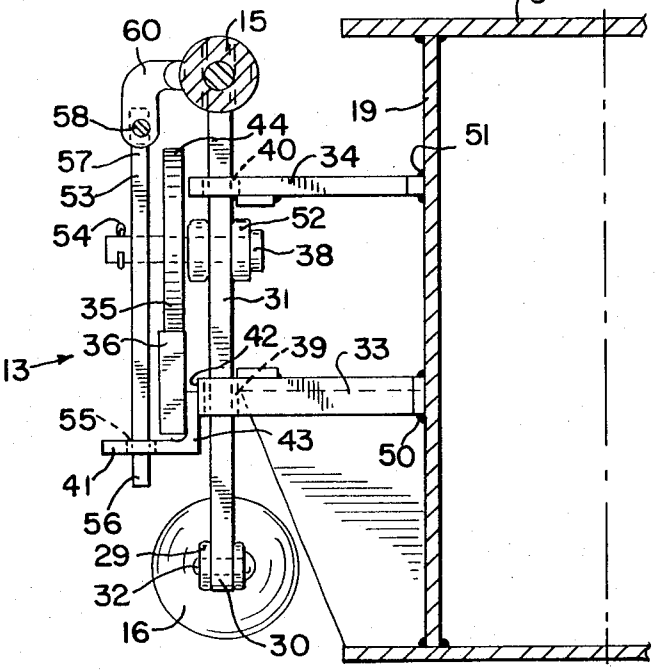
FIG. 3 is a sectional view of FIG. 2 as indicated by section line 3—3.
Figure 2:
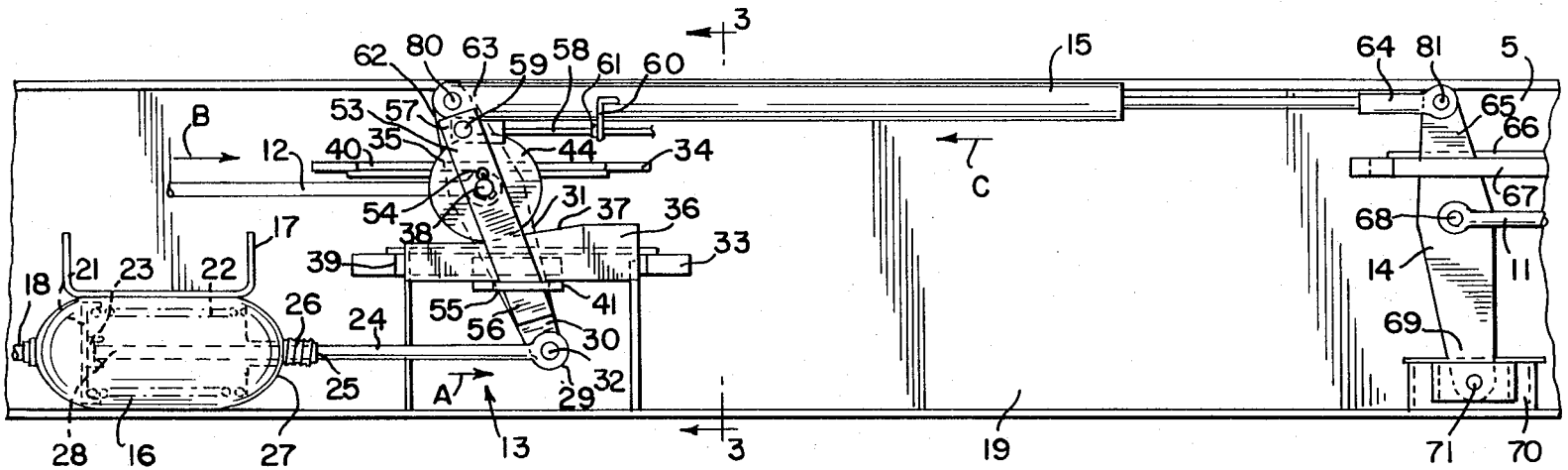
FIG. 2 is an enlarged view of that portion of FIG. 1 showing the brake cylinder lever support.

FIGS. 2 and 3 show in enlarged detail a side elevation view and, as indicated by section lines 3—3 on FIG. 2, a partial sectional view of car 2 with assembly 13 mounted on it.

Referring to FIGS. 2 and 3, brake cylinder and lever assembly 13 is comprised of the brake cylinder 16 which is affixed to a center sill side member 19 by means of brake cylinder mounting bracket 17. Brake cylinder 16 is of conventional construction and typically has, as indicated by hidden lines, a packing 21, a biasing spring 22, and a rod end receiving cap 23. A brake cylinder push rod 24 extends axially through an opening 25 surrounded by a sealing boot 26 in end portion 27 of the cylinder 16.

A first end portion 28 of push rod 24 is seated in the cap 23 and a second end portion 29 of the push rod is pivotally engaged with a lower end portion 30 of a brake cylinder lever 31 by appropriate means, such as pivot pin 32.

Brake cylinder lever assembly 13 is further comprised of a lower lever guide 33, an upper lever guide 34, a lever assembly support means, such as wheel or roller 35 and a roller support member 36 having an inclined roller support ramp 37. Roller 35 is pivotally or rollingly engaged with an intermediate portion of lever 31 by appropriate means, such as pin 38.

Each lower lever guide 33 and upper lever guide 34 has an elongated slot 39 and 40, respectively, extending substantially parallel to the side member 19 of center sill 5 and lever 31 is loosely or slidingly received within the slots 39 and 40 to enable movement of the lever, guided by the slots, substantially parallel to the side member 19 of sill 3. As best shown in FIG. 3, guide members 33 and 34 each have an end portion 50 and 51, respectively, rigidly affixed, such as by welding, as shown, to a portion of side member 19 and extend laterally outward from side member 19.

A trigger lever guide member 41 is rigidly affixed to laterally outermost end portion 42 of guide member 33. Rigidly affixed to a laterally outward facing surface of the attachment portion 43 of member 41 is lever support member 36 having as best shown in FIG. 2, an inclined ramp portion 37 on which an outer peripheral surface 44 of roller 35 is rollingly supported.

Pin 38, in addition to pivotally and rollingly connecting support roller 35 to an intermediate portion of lever 31, also pivotally connects a clevis 52, which is affixed to rod 12, and a trigger lever 53 to the lever 31. Appropriate assembly retaining means, such as cotter key 54, maintain these components assembled on the pin 38.

Trigger lever guide member 41 has a fulcrum slot 55 extending through it and a lower portion 56 of trigger lever 53 extends through and loosely fits within fulcrum slot 55.

Trigger lever 53 has an upper end portion 57 which is pivotally connected to a trigger rod 58 by appropriate means, such as pivot pin 59. Trigger rod 58 extends substantially parallel to slack adjuster assembly 15 and is slidingly received within an adjuster bracket 60 mounted on the slack adjuster assembly 15. An actuating collar 61 is affixed on trigger rod 58 and this collar coacts with adjuster bracket 60 to make the brake system self-adjusting in response to wear of the brake shoes.

Also, brake cylinder lever 31 has an upper end portion 62 which is pivotally connected to a first end portion 63 of slack adjuster assembly 15 by a pivot pin 80.

As shown in FIG. 2, a second end portion 64 of slack adjuster assembly 15 is pivotally connected to an upper end portion 65 of dead or transfer lever 14 by a pivot pin 81. Dead lever 14 is guided in an elongated slot 66 in a dead lever guide bracket 67 and has an intermediate portion pivotally connected with brake rod 11 by a pivot pin 68. A lower end portion 69 of dead lever 14 is pivotally engaged to a mounting bracket 70 by a pivot pin 71. Mounting bracket 70 is affixed to a portion of side member 19 of the center sill 5.

While the assembly and system shown constitutes the preferred embodiment, it will be readily understood that brake rod 11 could be connected directly to, or be a part of, end 64 of slack adjuster assembly 15. Also, rod 11 could be connected directly to end portion 62 of lever 31, if the slack adjuster is omitted from the system.

Having specifically described above the structural details of the invention, operation of the invention is as follows.

When it is desired to slow down or stop railway car 2 a pressurized fluid, such as air, is admitted into conduit 18 and communicated to brake cylinder 16. The air pressure forces the packing 21 and cup 23 to the right, as indicated by the directional arrow A as shown in FIG. 2, which causes push rod 24 to be forced outwardly or extend from the cylinder against the urging of spring 22. As rod end 29 is pivotally connected to end portion 30 of brake cylinder lever 31, the lower portion 30 is also forced to the right, or away from cylinder 16 causing roller 35 to roll to the right or upwardly on inclined ramp portion 37 of lever assembly support member 36. The weight of the assembly, by being supported on pin 38, is carried by the roller as it ascends up the ramp.

As brake rod 12 is pivotally connected to the intermediate portion of lever 31 and slack adjuster assembly 15 is connected to the upper end portion 62 of lever 31, lever 31 simultaneously commences to pivot about pin 38 causing brake rod 12 to move in the direction indicated by arrow B and the slack adjuster assembly 15 to move in the direction indicated by the arrow C for forcing brake beam assemblies 9 and 10 into frictional engagement with wheel trucks 3 and 4, respectively.

Due to the fact that the lower end portion 56 of trigger lever 53 is confined in fulcrum slot 55 of lever guide 41 the trigger lever is forced to pivot about pin 38 as the roller is forced to roll up ramp 37 against the urging of gravity and spring 22. Linear movement of the roller assembly up the ramp thus causes end portion 57 of trigger lever 53 to rotate clockwise about pin 38 and forces the trigger rod 58 to slide to the right through bracket 60 for causing collar 61 to actuate the conventional slack adjuster assembly 15 in a conventional manner well known to those skilled in the art of railway brake design. Increased extension of rod 24 out of cylinder 16 causes increased movement of roller 35 and the components carried with it by pin 38 up ramp 37 and also causes increased counterclockwise pivotal movement of lever 31 about pin 38 to increase the frictional engagement of the brake shoes with the wheels.

Upon achievement of sufficient braking action, the air pressure in conduit 18 is released. Consequently, spring 22 commences to urge packing 21 rearwardly or to the left (as shown in FIG. 2) and the weight of the components supported on roller 35 by pin 38 urges the roller to roll down the ramp portion 37 of support member 36.

Simultaneously, brake lever 31 is caused to pivot clockwise about pivot pin 38 for causing rod 12 to travel in a direction opposite that indicated by arrow B and rod or slack adjuster assembly 15 to move in a direction opposite that indicated by arrow C. These motions force the brake beams away from the wheels to reduce or remove contact with the wheels.

Also, simultaneously, trigger lever 53 moves counterclockwise about pivot pin 38 to return to its original position substantially as shown in FIG. 2.

The weight of the components on roller 35 serves to cause the roller to travel, or be gravitationally urged to travel, to the lowermost portion of the ramp and consequently aids in pushing the push rod all the way back into the cylinder and also to force rods 11, via slack adjuster 15 and dead lever 14, and 12 in a direction opposite to that indicated by arrows C and B, respectively, to aid in assuring that the brake beams are no longer in dragging frictional contact with the wheels of the wheel trucks.

In essence, the assembly, as shown and described, provides a biasing means for urging the brake lever support means in a direction for urging first and second brake means out of braking contact with the respective wheel trucks to which they are engaged and also urges the brake cylinder push rod toward, or to, a nonextended, nonbraking position to substantially eliminate energy wasting parasitic drag loads and unnecessary component wear.

Biasing the assembly toward a "brake-off" position serves to cause the brakes to return to an "off" position after they have been applied and also serves as a deterrent to having the brakes being urged toward an unwanted "brake-on" position by other conditions, such as abrupt acceleration of the car.

As disclosed above, this invention provides an efficient, effective structure for supporting a railway car brake cylinder lever in a manner which does not require costly openings and consequent reinforcement of the center sill. Additionally, due to supporting the assembly on a roller on an inclined ramp the rollingly supported assembly serves to aid in assuring the brakes return to a non-drag or complete "brake off" position to increase energy efficiency and reduce component wear.

What is claimed is:

1. In a railway car having a longitudinally extending draft structure and a brake system, said brake system having a first brake rod for connection to a first brake means at a first wheel truck and a second brake rod for connection to a second brake means at a second wheel truck and a braking linear force imposer having a nonextended, nonbraking position and an extended braking position, an improved brake lever assembly comprising:

a brake lever mounted in a substantially vertically extending position, said brake lever having a first end portion pivotally connected to said linear force imposer, a second end portion pivotally connected to one of said first and said second brake rods and an intermediate portion pivotally connected to said other of said first and said second brake rods;

guide means for enabling said brake lever to move substantially parallel to said draft structure;

brake lever support means pivotally engaged with a portion of said brake lever intermediate said first and said second end portions of said brake lever; and biasing means for urging said brake lever support means in a direction for urging said first and said second brake means out of braking contact with said respective first and second wheel trucks and for urging said linear force imposer to said nonextended, nonbraking position for eliminating brake drag of said brake means on said wheel trucks.

2. The invention as defined in claim 1 in which said brake lever is mounted external of, and laterally spaced from, said draft structure.

3. The invention as defined in claim 2 in which said draft structure is a center sill and said brake lever is laterally outwardly spaced from a side member of said center sill.

4. The invention as defined in claim 3 in which said guide means is at least one elongated slot in a guide member affixed to said side member of said center sill.

5. The invention as defined in claim 1 in which said brake lever support means is a roller pivotally and rollingly engaged with said brake lever.

6. The invention as defined in claim 5 in which said biasing means is an inclined ramp and said roller is supportingly and rollingly positioned on said ramp to support said lever assembly and said roller is impelled by gravity to roll down said ramp to urge said brake means out of braking contact with said wheel trucks.

7. The invention as defined in claim 6 in which said roller and one of said first and said second brake rods are connected to said intermediate portion of said brake lever by one pivot pin.

8. The invention as defined in claim 7 together with a trigger lever pivotally engaged with said one pivot pin.

9. The invention as defined in claim 8 in which said trigger lever has a first end portion engaged in a fulcrum slot and a second end portion pivotally engaged with a trigger rod.

10. The invention as defined in claim 9 in which said second end portion of said brake lever is pivotally connected to a slack adjuster assembly and said slack adjuster assembly is connected to one of said first and said second brake rods.

11. The invention as defined in claim 10 in which said trigger rod coacts with said slack adjuster assembly to automatically adjust said brake means.

12. The invention as defined in claim 10 in which said slack adjuster assembly has a first end portion pivotally connected to said second end of said brake lever and a second end portion connected to a dead lever and said one of said first and said second brake rods is connected to said dead lever for operating said brake means.

13. A brake system for a railway car having at least two longitudinally spaced wheel trucks, said brake system comprising, in combination:

brake means operatively connected to each of said wheel trucks, said brake means having a nondrag position with respect to said wheel trucks;

brake lever means mounted in a substantially vertically extending position intermediate said wheel trucks;

connection means connecting a first end portion of said lever means with one of said brake means and connecting an intermediate portion of said lever means with another of said brake means;

linear force imposing means connected to a second end portion of said lever means, said linear force imposing means having a nonextended position;

brake lever support means for pivotally supporting said brake lever means on said railway car; and biasing means for urging said brake lever support means in a direction for urging said brake means to said nondrag position and for urging said linear force imposing means to said nonextended position.

* * * * *